US007086732B2

(12) United States Patent
Kasperchik et al.

(10) Patent No.: US 7,086,732 B2
(45) Date of Patent: Aug. 8, 2006

(54) POROUS FUSIBLE INKJET MEDIA WITH FUSIBLE CORE-SHELL COLORANT-RECEIVING LAYER

(75) Inventors: Vladek P. Kasperchik, Corvallis, OR (US); Gary Allan Ungefug, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/629,230

(22) Filed: Jul. 28, 2003

(65) Prior Publication Data

US 2005/0025911 A1 Feb. 3, 2005

(51) Int. Cl.
*B41J 2/01* (2006.01)

(52) U.S. Cl. ..... 347/105; 347/101; 428/32.1

(58) Field of Classification Search ..... 347/105, 347/101, 100, 95, 96; 428/195, 32.1
See application file for complete search history.

(56) References Cited

U.S. PATENT DOCUMENTS 5,374,475 A 12/1994 Walchli
5,512,619 A * 4/1996 DeWacker et al. ..... 524/56
5,576,088 A * 11/1996 Ogawa et al. ..... 347/105
5,723,276 A 3/1998 Shaw-Klein et al.
5,756,273 A * 5/1998 Wang et al. ..... 430/537
6,177,187 B1 1/2001 Niemoller et al.
6,375,320 B1 * 4/2002 Chu et al. ..... 347/105
6,380,280 B1 4/2002 Kapusniak et al.
6,402,316 B1 6/2002 Ichinose
6,723,397 B1 * 4/2004 Wexler ..... 428/32.21
2002/0037395 A1 3/2002 Zhong et al.
2002/0155260 A1 * 10/2002 Chen et al. ..... 428/195
2003/0143344 A1 * 7/2003 Yau et al. ..... 428/32.1

FOREIGN PATENT DOCUMENTS

EP 0 227 245 B1 9/1993
EP 1 167 060 A2 1/2002
EP 1 184 195 A2 3/2002
EP 1184195 A2 * 3/2002

* cited by examiner

*Primary Examiner*—Manish S. Shah

(57) ABSTRACT

A fusible print medium having a photobase layer, a vehicle sink layer, and a colorant-receiving layer. The colorant-receiving layer includes core-shell polymer particles that have a hydrophilic shell and a fusible hydrophobic core. Upon exposure to a sufficient heat, the colorant-receiving layer inverts from a porous, hydrophilic surface into a continuous layer that encapsulates colorant in hydrophilic domains. A method of forming the fusible print medium and producing a photographic quality image is also disclosed.

18 Claims, 2 Drawing Sheets

POROUS FUSIBLE INKJET MEDIA WITH FUSIBLE CORE-SHELL COLORANT-RECEIVING LAYER

BACKGROUND OF THE INVENTION

Inkjet printers are used in numerous applications to print text and/or graphics by utilizing piezoelectric or thermal technologies to deposit inkjet ink on a print medium. The inkjet ink includes a colorant and an ink vehicle, which is typically an aqueous-based solution that includes water and a mixture of water-soluble, organic solvents. As used herein, the term "colorant" refers to a dye, a pigment, or a mixture of at least one dye and at least one pigment. The ink vehicle optionally includes buffers, surfactants, humectants, and biocides to achieve the desired properties of the inkjet ink.

To achieve photographic image quality, the print medium used in inkjet printing must be fast drying and resist smearing, air, light, and moisture. In addition, the print medium should provide good color fidelity and high image resolution. Print media with photographic image quality generally include multiple coatings on a substrate or photobase layer. The coatings are formed from inorganic or organic materials, such as inorganic particles or organic polymers.

Conventional print media used in digital printing are typically categorized into two groups: porous media and swellable media. Porous media generally have an ink receiving layer that is formed from a porous, inorganic oxide bound with a polymer binder. As used herein, the term "porous" refers to a material that has a significant amount of voids, capillaries, communicated holes, and/or fissures. In the porous media, physical porosity is present. Typically, the polymer binder is present from 1 percent by weight ("wt %") to 50 wt %, such as from 1 wt % to 10 wt %. Inkjet ink is absorbed into the pores of the ink receiving layer and the colorant is fixed in the porous medium by mordants incorporated in the ink receiving layer or by the surface of the inorganic oxides. Porous media have a short drytime and good resistance to smearing because the inkjet ink is easily absorbed into the pores of the ink receiving layer. However, porous media do not exhibit good resistance to fade. As used herein, the term "fade" or "fading" refers to light fade, dark fade, and air fade. In addition, while some porous media are resist to water and humidity, many porous media do not exhibit this desirable property.

In swellable media, the ink receiving layer is a continuous layer of a swellable, polymer matrix. As used herein, the term "continuous" refers to a material that does not have physical porosity. When the inkjet ink is applied to a swellable medium, the inkjet ink is absorbed by swelling of the polymer matrix and the colorant is immobilized inside the continuous layer. Since the colorant is protected from the outside environment, swellable media have greater resistance to light and dark/air fade than the porous media. However, the swellable media generally have reduced smearfastness and a longer drytime than porous media.

To overcome the undesirable properties of porous and swellable media, fusible or sealable print media have been developed and continue to be researched. With a fusible print medium, heat and/or pressure is applied after printing to produce a printed image that has improved resistance to water, humidity, smearing, and fading.

Recording media having a photobase layer, an inorganic particle layer, and at least one porous resin layer have been disclosed. The resin layer includes heteromorphic microspheres that are formed from a thermoplastic resin. During printing, inkjet ink passes through the resin layer and into the inorganic particle layer, which absorbs the inkjet ink and fixes the dye to the recording medium. The recording medium is heated to convert the resin layer into a film by fusion-bonding the microspheres to one another. The recording medium is alleged to have improved waterfastness and resistance to weather.

In addition, recording media having a temporary substrate and an ink absorption layer have been disclosed. The ink absorption layer includes porous, thermoplastic polymer particles of a predetermined size and shape. After printing, the recording medium is heated to a temperature above the melting point of the thermoplastic polymer particles to convert the ink absorption layer into a film.

Fast drying, record media have also been disclosed. The record medium has a microporous layer formed on a planar supporting layer. The microporous layer utilizes thermoplastic polymers that form capillaries in the microporous layer. If the microporous layer is opaque, it is converted to a transparent layer by heat, pressure, and/or exposure to solvents.

It would be desirable to provide an improved fusible print medium that has the desirable properties of the porous and swellable media. The fusible print medium would have a short drytime and increased resistance to smearing, fading, water, and humidity.

BRIEF SUMMARY OF THE INVENTION

The present invention relates to a fusible print medium comprising a photobase layer, a vehicle sink layer, and a colorant-receiving layer. The colorant-receiving layer comprises core-shell polymer particles having a hydrophilic shell and a fusible hydrophobic core, which are configured to undergo a phase inversion that encapsulates a colorant in the colorant-receiving layer. Upon exposure to heat and/or pressure, the colorant-receiving layer inverts to a continuous layer having a hydrophobic surface that encapsulates the colorant confined to a hydrophilic phase, which migrates inward during the phase inversion.

The present invention also relates to a method of producing a photographic quality image. The method comprises providing a fusible print medium having a photobase layer, a vehicle sink layer, and a colorant-receiving layer. The colorant-receiving layer comprises core-shell polymer particles having a hydrophilic shell and a fusible hydrophobic core. A desired image is printed by depositing inkjet ink on the fusible print medium. The colorant-receiving layer is subsequently inverted from a porous, hydrophilic surface into a continuous, hydrophobic film by exposing the print medium to heat and/or pressure. After the phase inversion, a colorant from the inkjet ink is encapsulated in hydrophilic domains in the colorant-receiving layer, which protects the colorant from exposure to the outside environment. The colorant-receiving layer is also fused by contacting the fusible hydrophobic core with a coalescing agent.

A method of producing a fusible print medium is included in the present invention. The method comprises forming a vehicle sink layer on a photobase layer and forming a colorant-receiving layer on the vehicle sink layer. The colorant-receiving layer is configured to invert from a porous, hydrophilic surface to a continuous layer that has a hydrophobic surface upon exposure to heat, pressure, or combinations of heat and pressure. The colorant-receiving layer comprises core-shell polymer particles having a hydrophilic shell and a fusible hydrophobic core.

DETAILED DESCRIPTION OF THE INVENTION

A print medium for use in inkjet printing is disclosed. The print medium is fusible and includes a photobase layer, a vehicle sink layer, and a colorant-receiving layer that is capable of a phase inversion. The colorant-receiving layer includes core-shell polymer particles that invert from a hydrophilic-surface phase to a hydrophobic-surface phase upon exposure to heat or heat and pressure. To provide improved photopermanence and fade resistance to a printed image, the phase inversion encapsulates the colorant in the colorant-receiving layer and protects it from the outside environment. The print medium also has a short drytime and, therefore, provides the optimal properties of both porous and swellable media.

Figure 1:
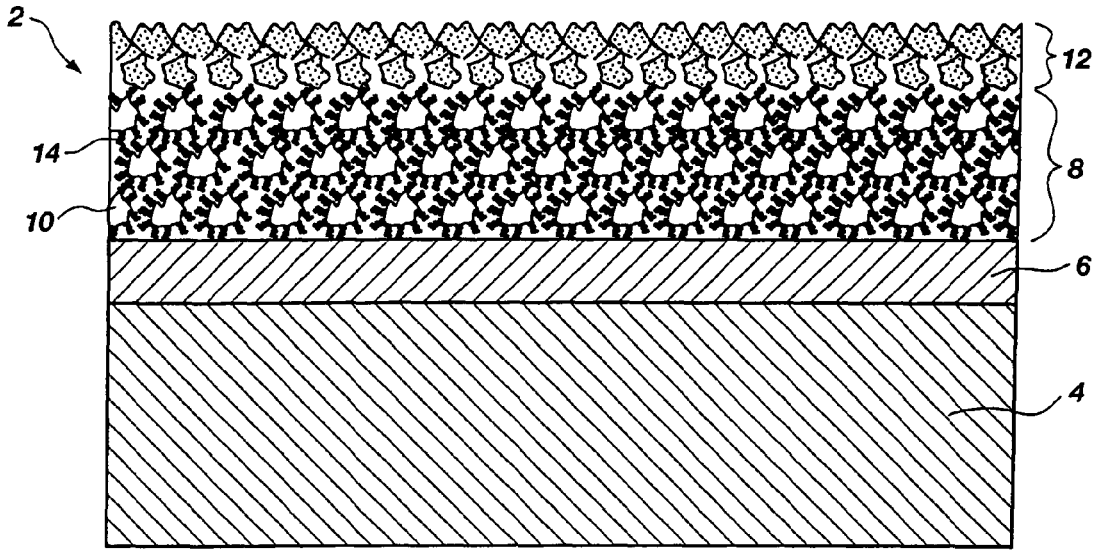
FIG. 1 schematically illustrates a fusible print medium of the present invention.

As illustrated in FIG. 1, the print medium 2 has a photobase layer 4, a vehicle sink layer 6 overlying the photobase layer 4, and a colorant-receiving layer 8 overlying the vehicle sink layer 6. The print medium 2 optionally has a topcoat layer 12. The photobase layer 4 may be formed from a transparent, opaque, or translucent material that provides support to the overlying layers as the print medium 2 is transported through an inkjet printer. The photobase layer 4 may include a hard or flexible material made from a polymer, a paper, a glass, a ceramic, a woven cloth, or a non-woven cloth material. Polymers that may be used as the photobase layer 4 include, but are not limited to, polyesters, cellulose esters, polyurethanes, polyester-ethers, polyether ketones, vinyl polymers, polystyrene, polyethylene terephthalate, polysulfones, polybutylene terephthalate, polypropylene, methacrylates, diallyl phthalates, cellophane, acetates, cellulose diacetate, cellulose triacetate, celluloid, polyvinyl chloride, polyvinyl acetate, polycarbonates, and mixtures thereof. For sake of example only, the photobase layer 4 may include a paper that is coated by co-extrusion with a high or low density polyethylene, polypropylene, or polyester. The photobase layer 4 may be from approximately 5 μm to approximately 1000 μm thick, depending on a desired end application for the print medium 2.

The vehicle sink layer 6 is formed over the photobase layer 4 and may absorb an ink vehicle of the inkjet ink used during printing. The vehicle sink layer 6 may absorb a substantial portion of the ink vehicle as the inkjet ink penetrates through the overlying colorant-receiving layer 8. The vehicle sink layer 6 may be a sufficient thickness to absorb the ink vehicle without causing coating defects to occur or reducing the mechanical strength of the print medium 2. The vehicle sink layer 6 may be from about 1 μm to about 200 μm thick.

To absorb the ink vehicle, the vehicle sink layer 6 may be formed from porous inorganic particles bound in a polymer binder. The porous inorganic particles may include, but are not limited to, silica, silica-magnesia, silicic acid, sodium silicate, magnesium silicate, calcium silicate, alumina, alumina hydrate, barium sulfate, calcium sulfate, calcium carbonate, magnesium carbonate, magnesium oxide, kaolin, talc, titania, titanium oxide, zinc oxide, tin oxide, zinc carbonate, pseudo-boehmite, bentonite, hectorite, clay, and mixtures thereof. The porous inorganic particles may be present in the vehicle sink layer 6 from about 15 wt % to about 99 wt % based on the total solids content in the vehicle sink layer 6. In one embodiment, the porous inorganic particles are present in the vehicle sink layer 6 from about 40 wt % to about 99 wt %. In another embodiment, the vehicle sink layer 6 includes from about 80 wt % to about 99 wt % porous inorganic particles. More preferably, the vehicle sink layer 6 includes from about 90 wt % to about 99 wt % porous inorganic particles.

The polymer binder used in the vehicle sink layer 6 may be a water-soluble or water-dispersible polymer including, but not limited to, vinyl acetate homo- or co-polymers, acrylate (co)polymers, styrene/butadiene copolymers, ethylene or vinyl chloride copolymers, polyurethane dispersions, polyvinyl alcohol ("PVA") or derivatives thereof, polyvinylpyrrolidone, starch or derivatives thereof, gelatin, or derivatives thereof, cellulose or derivatives thereof (such as cellulose ethers, carboxymethyl cellulose, hydroxyethyl cellulose, or hydroxypropylmethyl cellulose), maleic anhydride polymers or copolymers thereof, acrylic ester copolymers, polyacrylamide, casein, and water- or ammonia-soluble polyacrylates or polymethacrylates and copolymers thereof. In addition, mixtures of these polymer binders may be used. Preferably, the vehicle sink layer 6 is formed from silica or alumina particles bound in PVA. The polymer binder may be present in the vehicle sink layer 6 from about 1 wt % to about 50 wt %. Preferably, the polymer binder is present from about 1 wt % to about 10 wt %.

The colorant-receiving layer 8, which is formed over the vehicle sink layer 6, may absorb the colorant used in the inkjet ink. The colorant-receiving layer 8 is porous and has a fusible hydrophobic core and a hydrophilic surface (shell) before images are printed on the print medium 2. However, the colorant-receiving layer 8 becomes continuous and has a hydrophobic surface upon exposure to heat or heat and pressure, such as after printing. While the colorant-receiving layer 8 is porous before printing, it is also substantially non-absorbent of the ink vehicle. Therefore, the ink vehicle passes through the colorant-receiving layer 8 and into the vehicle sink layer 6, while the colorant remains in the colorant-receiving layer 8. Since both the colorant-receiving layer 8 and the vehicle sink layer 6 are porous, the inkjet ink applied to the print medium 2 easily penetrates into these layers, which provides a fast drytime of the print medium 2.

The colorant-receiving layer 8 may be formed from core-shell polymer particles 10. As used herein the term "core-shell polymer" refers to a polymer having a hydrophilic shell and a fusible hydrophobic core. The hydrophilic shell may be a hydrophilic polymer that includes, but is not limited to, a functionalized hydrophilic derivative of a polyolefin, a polyester, a polyvinyl halide, or an acrylic. For instance, the hydrophilic polymer may be polyvinyl pyrrolidone, poly(2-ethyl-2-oxazoline), polyvinyl alcohol, acrylic polymers, copolymers that have hydrophilic groups (hydroxy or carboxy groups), cellulose polymers, starch, gelatin, albumin, casein, cation starch, natural resins such as gum arabic and sodium alginate, polyamide, polyacrylamide, polyethylene imine, polyvinyl pyridylium halide, melamine resins, polyurethane, polyester, sodium polyacrylate, or mixtures thereof. The core-shell polymer particles 10 may be formed by conventional techniques, as known in the art.

The hydrophilic shell may also possess mordant properties to provide the colorant-receiving layer 8 with the ability to retain the colorant. The hydrophilic shell may include a functional group having a charge opposite to a charge on the colorant so that the colorant and mordant are electrostatically attracted to one another. For example, if the colorant in the inkjet ink is an anionic dye, a water-soluble or swellable cationic polymer may be used as the mordant. The hydrophilic shell may include a cationic group, such as an amino, tertiary amino, amidoamino, pyridine, or imine group. Examples of the cationic groups used in the hydrophilic shell include, but are not limited to, polyquaternary ammonium salts, cationic polyamines, polyamidins, cationic acrylic copolymers, guanidine-formaldehyde polymers, polydimethyl diallylammonium chloride, diacetone acrylamide-dimethyldiallyl ammonium chloride, polyethyleneimine, and a polyethyleneimine adduct with epichlorhydrin. However, it is understood that other functional groups may provide mordant properties if the colorant is a nonionic dye, a cationic dye, or a pigment.

The fusible hydrophobic core may be a hydrophobic polymer having a glass transition temperature ("$T_g$") higher than ambient temperature but lower than a temperature at which other components in the print medium 2 or the inkjet ink may decompose, oxidize, or discolor. For instance, the fusible hydrophobic core may have a $T_g$ from about 35° C. to about 180° C. Preferably, the fusible hydrophobic core has a $T_g$ from about 45° C. to about 160° C. More preferably, the $T_g$ is about 60° C. to about 130° C. It may also be desirable for the hydrophobic polymer used in the fusible hydrophobic core to be plasticized by at least one of the solvents in the inkjet ink.

Since the fusible hydrophobic core has a $T_g$ higher than ambient temperature, the core-shell polymer particles 10 are prevented from merging, which maintains the porosity of the print medium 2 before printing. However, after printing, the core-shell polymer particles 10 may be fused into a continuous film by exposing the colorant-receiving layer 8 to a temperature above the $T_g$ of the fusible hydrophobic core. An optional coalescing agent may be present in the inkjet ink to further reduce the $T_g$ during the fusion of the colorant-receiving layer 8, as discussed in detail below.

The fusible hydrophobic core may be a water-insoluble, hydrophobic fusible polymer including, but not limited to, acrylic resins, styrenic resins, or cellulose derivatives, such as cellulose acetate, cellulose acetate butyrate, cellulose propionate, cellulose acetate propionate, and ethyl cellulose; polyvinyl resins such as polyvinyl chloride, copolymers of vinyl chloride and vinyl acetate and polyvinyl butyral, polyvinyl acetal, ethylene-vinyl acetate copolymers, ethylene-vinyl alcohol copolymers, and ethylene-allyl copolymers such as ethylene-allyl alcohol copolymers, ethylene-allyl acetone copolymers, ethylene-allyl benzene copolymers, ethylene-allyl ether copolymers, ethylene acrylic copolymers and polyoxy-methylene; polycondensation polymers, such as, polyesters, including polyethylene terephthalate, polybutylene terephthalate, polyurethanes and polycarbonates, or mixtures thereof. For sake of example only, the fusible hydrophobic core may be a copolymer of ethylene and vinyl acetate or a styrene-butadiene copolymer.

The core-shell polymer particles 10 may be present in an amount sufficient to absorb the colorant and maintain the porous nature of the colorant-receiving layer 8. The ability of the core-shell polymer particles 10 to absorb the colorant may depend on the mordanting capacity of the hydrophilic shell and the surface area of the core-shell polymer particles 10. The absorbing capacity of the colorant-receiving layer 8 may also be affected by the colorant content in the inkjet ink and the amount of inkjet ink applied per unit of the surface area of the fusible print medium.

The core-shell polymer particles 10 are formed by conventional techniques, such as by reacting or absorbing the hydrophilic shell and the fusible hydrophobic core with one another. For example, the particles of the fusible hydrophobic core and the hydrophilic shell may be obtained by:

1. Graft polymerization of hydrophilic monomers on the surface of dispersed hydrophobic particles;
2. Block co-polymerization of hydrophilic and hydrophobic monomers; and
3. Dispersion of hydrophobic polymer particles in a solution of hydrophilic polymer with subsequent addition of a non-solvent to the mixture. The non-solvent causes precipitation of the hydrophilic polymer onto the hydrophobic polymer particles and subsequent formation of the hydrophilic layer on their surface.

Figure 2:
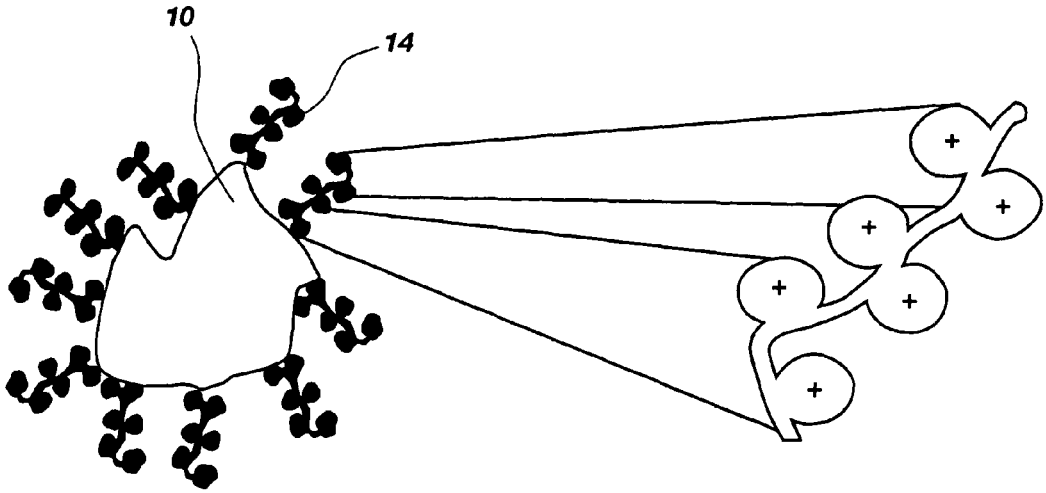
FIG. 2 shows an enlarged view of core-shell polymer particles used in a colorant-receiving layer of the present invention.

To fix the colorant in the colorant-receiving layer 8, the hydrophilic shell may have mordant properties. For instance, as shown in FIGS. 1 and 2, a mordant 14 may be fused or grafted to the surface of the hydrophilic shell. A charge on the mordant 14 may be opposite to a charge on the colorant so that the colorant and mordant 14 are electrostatically attracted to one another. Since many colorants used in inkjet inks are anionic dyes, the mordant 14 may be cationic or have a negative charge. The mordant 14 may be a hydrophilic, cationic species, such as a polyamine, a polyethyleneimine or derivative thereof, a polyamidoamine, or a quaternary amine polymer. For instance, the mordant may include, but is not limited to, a polyquaternary ammonium salt, a cationic polyamine, a polyamidin, a cationic acrylic copolymer, a guanidine-formaldehyde polymer, polydimethyl diallylammonium chloride, diacetone acrylamide-dimethyldiallyl ammonium chloride, polyethyleneimine, and a polyethyleneimine adduct with epichlorhydrin. Alternatively, the mordant 14 may be an additive incorporated into the colorant-receiving layer 8. For example, the mordant 14 may be a polyamine with a vinyl backbone, a polyethyleneimine or a derivative thereof, a polyamidoamine, or a quaternary amine polymer.

In one embodiment, a latex vinyl polymer is used as the hydrophilic shell and the fusible hydrophobic core includes a copolymer of acrylate and methacrylate, a polymer based on styrene-acrylic, a vinyl acetate-acrylic, a vinyl acetate-ethylene, or a copolymer of acrylonitrile.

The colorant-receiving layer 8 may also include a small amount of polymer binder to bind the core-shell polymer particles 10 into a layer. The polymer binder in the colorant-receiving layer 8 may be one of the polymer binder materials described above for use in the vehicle sink layer 6. For instance, the polymer binder may be a water-soluble or water-dispersible polymer such as gelatin, polyvinyl pyrrolidone, a water-soluble cellulose derivative, polyvinyl alcohol or its derivatives, polyacrylamide, polyacrylic acid, or a water-soluble acrylic acid co-polymer. Preferably, the polymer binder of the colorant-receiving layer 8 is polyvinyl alcohol or a water-soluble or water-dispersible derivative thereof. The amount of polymer binder present in the colorant-receiving layer 8 may be sufficient to bind the core-shell polymer particles together without blocking the pores between the core-shell polymer particles 10.

The colorant-receiving layer 8 may be of a sufficient thickness to absorb the colorant from the inkjet ink and encapsulate the colorant in hydrophilic domains 18 after the phase inversion. The colorant-receiving layer 8 may be approximately 1 μm to 100 μm thick and preferably is 10–50 μm thick.

The print medium 2 optionally has a topcoat layer 12 formed from particles of porous inorganic oxides that are bound using a polymer binder. For example, the topcoat layer may include silica or alumina particles bound in PVA.

To produce the multiple layers of the print medium 2, a coating formulation of each of the layers may be formed by combining the components of each layer, as known in the art. The coating formulation may optionally include surfactants, pH adjusting agents, thickeners, dispersing agents, and/or lubricants to obtain the desired properties of each layer. The coating formulation may be applied to the photobase layer 4 or underlying layers by conventional coating techniques. For example, the coating formulation may be applied using a roll coater, air knife coater, blade coater, bar coater, gravure coater, rod coater, curtain coater, die coater, or air brush. Each of the layers may be separately formed or may be simultaneously formed, as known in the art. The coating formulations may be dried at a temperature below the $T_g$ of the fusible hydrophobic core so that phase inversion of the colorant-receiving layer 8 does not occur while the print medium 2 is being produced.

Figure 3A:
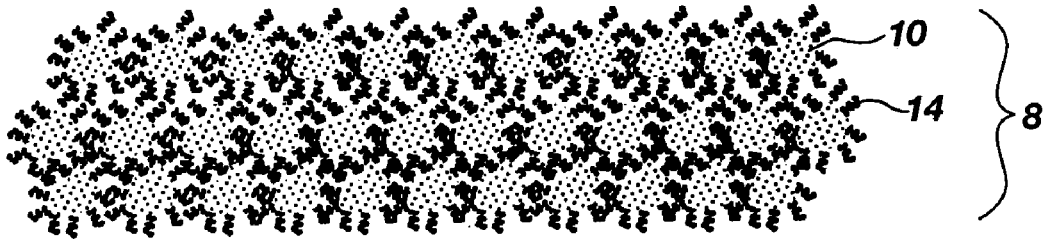
FIGS. 3A–3C illustrate the colorant-receiving layer of the fusible print medium before and after the phase inversion.
Figure 3B:
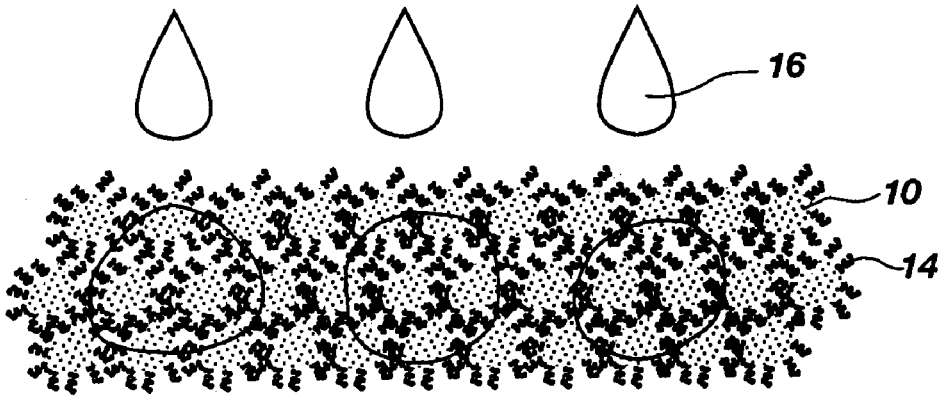

Once the print medium 2 is formed, a desired image, such as text, graphics, or a combination thereof, may be printed using an inkjet printer and inkjet ink. As shown in FIGS. 3A and 3B, drops 16 of the inkjet ink are deposited on the colorant-receiving layer 8 of the print medium 2. While FIG. 3A–3C only shows the colorant-receiving layer 8, it is understood that the photobase layer 4, the vehicle sink layer 6, and, optionally, the topcoat layer 12, are also present. The inkjet printer and inkjet ink are not critical to the operability of the present invention and, therefore, are not discussed in detail herein. Rather, it is understood that any conventional inkjet printer or inkjet ink may be used. However, as discussed in more detail below, the inkjet ink may optionally include a coalescing agent that lowers the $T_g$ of the fusible hydrophobic core.

As the inkjet ink is deposited on the print medium 2, the ink drops 16 may penetrate through the optional topcoat layer 12 and into the colorant-receiving layer 8. The colorant of the inkjet ink is fixed in the colorant-receiving layer 8 by forming a complex with the mordant 14, which is bound to the core-shell polymer particles 10. However, as previously described, the mordant 14 may also be an additive incorporated into the colorant-receiving layer 8. The ink vehicle passes through the colorant-receiving layer 8 and may be absorbed by the vehicle sink layer 6.

Figure 3C:
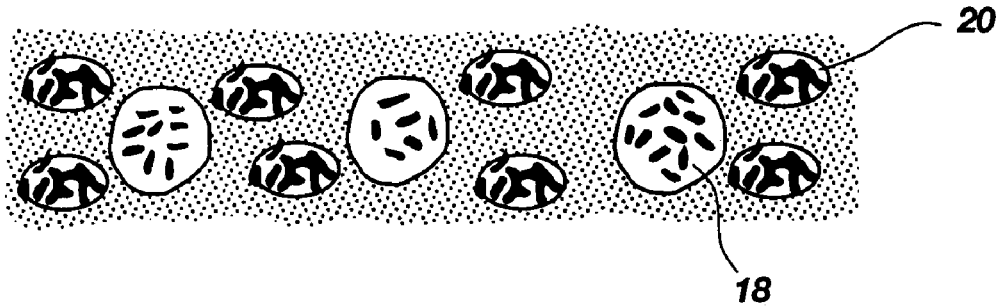

The print medium 2 may be exposed to heat of a sufficient temperature to invert the porous, hydrophilic surface of the colorant-receiving layer 8 into a layer that is continuous and has a hydrophobic surface. In other words, the heat melts the fusible hydrophobic core of the core-shell polymer particles 10. As the fusible hydrophobic core melts, the colorant is encapsulated in hydrophilic domains 18 in the hydrophobic environment of the fused hydrophobic core, as shown in FIG. 3C. Hydrophobic domains 20 having no colorant may also be formed. Since the colorant is encapsulated in the hydrophilic domains 18, it is protected from the outside environment. Therefore, the resulting printed image has increased resistance to fade, humidity, and water. In addition, since the colorant is encapsulated, the colorant's ability to migrate is reduced.

To apply a sufficient amount of heat to the print medium 2 to cause the phase inversion, a heat source may be used. The heat source may include, but is not limited to, a drying oven, an infrared ("IR") oven, a heat lamp, an IR lamp, a hot press, a laminator, or an iron. The temperature necessary to cause the phase inversion may vary depending on the $T_g$ of the fusible hydrophobic core used in the colorant-receiving layer 8. The temperature may be sufficiently higher than the $T_g$ of the fusible hydrophobic core to cause the fusible hydrophobic core to melt without causing the colorant or components in the print medium 2 to decompose, oxidize, or discolor. The temperature necessary to melt the fusible hydrophobic core may range from approximately 40° C. to 150° C. For instance, the temperature necessary to melt the fusible hydrophobic core may range from approximately 60° C. to 130° C. However, it is understood that this temperature may be lower if a coalescing agent is used in the inkjet ink.

The phase inversion may also occur by applying pressure to the print medium 2. For example, pressure rollers may be used to invert the porous, hydrophilic surface of the colorant-receiving layer 8 into a continuous, hydrophobic film. In addition, a combination of heat and pressure may be applied to the print medium 2 using heated rollers, such as those in a photocopier or hot laminator apparatus.

It is also contemplated that a coalescing agent may optionally be used in the inkjet ink to reduce the temperature at which the desired phase inversion of the colorant-receiving layer 8 occurs. The coalescing agent may provide the ability to swell and plasticize the hydrophobic polymer of the fusible hydrophobic core. The coalescing agent may be soluble or dispersible in the inkjet ink. The nature of the coalescing agent may therefore depend on the hydrophobic polymer used in the fusible hydrophobic core. The coalescing agent may be a linear or slightly branched glycol ether or ester having between 7 to 12 carbon atoms. For example, the coalescing agent may be an ether- or ester-alcohol including, but not limited to, 2,2,4-trimethyl-1,3-pentanediol monoisobutyrate, 1-methyl-2-pyrrolydone, diethylene glycol ("DEG") dibutyl ether, DEG monopropyl ether, DEG ethyl ether, 1,2-hexanediol, 2-butoxyethanol, ethylene glycol monobutyl ether, diethylene glycol monobutyl ether, diethylene glycol monomethyl ether, propylene glycol monomethyl ether, or dipropylene glycol monomethyl ether. 2,2,4-trimethyl-1,3-pentanediol monoisobutyrate is available under the trade name TEXANOL® from Eastman Chemical (Kingsport, Tenn.). Diethylene glycol monobutyl ether is available as Butyl Carbitol™ R6K28 from Union Carbide (Danbury, Conn.). The coalescing agent may also be volatile so that it diffuses out of the print medium 2 after the hydrophobic continuous layer is formed.

In addition to the hydrophobic polymers previously mentioned, it is also contemplated that a hydrophobic polymer with a higher $T_g$ may be used in the fusible hydrophobic core. While these higher $T_g$ hydrophobic polymers would generally require an unpractical temperature to invert the colorant-receiving layer 8 into a continuous layer, the $T_g$ of the fusible hydrophobic core may be lowered by contacting the fusible hydrophobic core with a coalescing agent. By lowering the $T_g$, hydrophobic polymers having higher $T_g$'s may be used in the colorant-receiving layer 8 because the print medium 2 may still be exposed to a practical temperature to cause the phase inversion. For instance, the coalescing agent may be used to lower the $T_g$ of the fusible hydrophobic core by between approximately 50° C. and approximately 100° C. The coalescing agent may also be used to plasticize the fusible hydrophobic core to form the continuous film.

In order to contact the fusible hydrophobic core, the coalescing agent may be added to the inkjet ink. When the inkjet ink is applied to the print medium 2, the coalescing agent absorbs into the fusible hydrophobic core. Therefore, the coalescing agent may be soluble in, and compatible with, other components of the inkjet ink. The coalescing agent may be present in the inkjet ink in a sufficient amount to lower the $T_g$ of the fusible hydrophobic core without impacting desirable properties of the inkjet ink. Preferably, the coalescing agent is present in the inkjet ink at less than 10 wt %. More preferably, the coalescing agent is present in the inkjet ink from about 1 wt % to about 5 wt %.

EXAMPLES

Example 1

Formation of the Core-shell Polymer

The core-shell polymer is prepared by a four-hour addition of a pre-emulsion of water (18 parts), Abex JKB surfactant (2 parts), itaconic acid (0.3 parts), styrene (29.7 parts), ethyl acrylate (17.5 parts), and acrylonitrile (2.5 parts) to a stirred reactor containing a trace of ferrous sulfate in water (55 parts) at 65° C. to 70° C. Simultaneously, ammonium persulfate (0.2 parts) in water (7 parts) and sodium metabisulfite (0.15 parts) in water (5 parts) are added in two separate feeds. When all feeds are completed, the reactor is held at 65° C. to 70° C. for 30 minutes. Then, an emulsion of water (35 parts), methyl methacrylate (29 parts), butyl acrylate (10 parts), methacrylic acid (0.5 parts), dimethylaminoethylmethacrylate (10.5 parts), Triton X-405 (4 parts), Trycol NP-4 (1part), and diammonium phosphate (0.15 parts) is added over a period of four hours while adding two separate feeds of ammonium persulfate (0.2 parts) in water (7 parts) and sodium metabisulfite (0.15 parts) in water (5 parts). The reactor mixture is held at 65° C. to 70° C. for four more hours after the feeds are completed. The product is a milky-white, latex polymer of particles having 43% to 45% solids. The core-shell polymer includes a hydrophobic core having a $T_g$ of about 45° C. and a hydrophilic shell having a $T_g$ of about 40° C.

Example 2

Formulation of the Vehicle Sink Layer Coating

A coating formulation of the vehicle sink layer is formed by combining from about 15 wt % to about 85 wt % porous silica or alumina particles (about 5 nm to about 15 nm diameter) and from about 1 wt % to about 15 wt % polyvinyl alcohol (average polymerization degree of 3500, saponification degree of 88%) in a dispersing vehicle, such as water or about 1% to about 10% ethanol in water. The coating formulation of the vehicle sink layer is coated on a photobase substrate.

Example 3

Formulation of the Colorant-Receiving Layer Coating

A coating formulation of the colorant-receiving layer is formed by combining from about 15 wt % to about 85 wt % (of polymer solids) of the latex polymer described in Example 1 with about 1 wt % to about 15 wt % polyvinyl alcohol. The latex polymer particle shell has a $T_g$ of about 45° C. to about 160° C. The hydrophilic shell also includes a cationic functionality derived from a polyquaternary ammonium salt, a cationic polyamine, a polyamidine, a cationic acrylic copolymer, a guanidine-formaldehyde polymer, a polydimethyl a diallylammonium chloride, a diacetone acrylamide-dimethyl diallyl ammonium chloride, a polyethyleneimine, or a polyethyleneimine adduct with epichlorohydrin as the mordant. The coating formulation of the colorant-receiving layer is coated over the vehicle sink layer.

Example 4

Formulation of the Topcoat Layer Coating

A coating formulation of a topcoat layer is formed by combining from about 15 wt % to about 85 wt % porous silica or alumina particles (from about 5 nm to about 15 nm diameter) and from about 1 wt % to about 15 wt % polyvinyl alcohol (average polymerization degree of 3500, saponification degree of 88%) in a dispersing vehicle, such as water or 1% to 10% ethanol in water. The topcoat layer is coated over the colorant-receiving layer.

After coating the vehicle sink layer, the colorant-receiving layer, and the topcoat layer on the photobase substrate, the layers are allowed to dry to produce the fusible print medium of the present invention.

Example 5

Generation of Printed Images having Improved Photopermanence and Fade Resistance A conventional inkjet ink is deposited on the fusible print medium to print a desired image. The inkjet ink penetrates through the topcoat layer and into the colorant-receiving layer. The colorant of the inkjet ink is fixed in the colorant-receiving layer by forming a complex with the mordant, while the ink vehicle passes through the colorant-receiving layer and is absorbed by the vehicle sink layer.

To achieve the phase inversion of the colorant-receiving layer, the fusible print medium is exposed to a temperature greater than about 35° C. The porous, hydrophilic surface of the colorant-receiving layer is inverted by the heat into a layer that is continuous and has a hydrophobic surface. As the fusible hydrophobic core melts, the colorant is encapsulated in hydrophilic domains in the hydrophobic environment of the fused hydrophobic core. Since the colorant is encapsulated, the printed image has improved photopermanence, fade resistance, and a short drytime.

The phase inversion is also obtained by applying pressure or a combination of heat and pressure to the fusible print medium. Pressure rollers or heated pressure rollers are used to invert the porous, hydrophilic surface of the colorant-receiving layer into a continuous, hydrophobic film.

Example 6

Generation of Printed Images having Improved Photopermanence and Fade Resistance A conventional inkjet ink that also includes 2,2,4-trimethyl-1,3-pentanediol monoisobutyrate or diethylene glycol monobutyl ether as the coalescing agent is deposited on the fusible print medium as described in Example 5. To achieve the phase inversion of the colorant-receiving layer, the fusible print medium is exposed to a temperature greater than about 35° C. or a combination of heat and pressure. As the fusible hydrophobic core melts, the colorant is encapsulated in hydrophilic domains in the hydrophobic environment of the fused hydrophobic core. The resulting printed image has improved photopermanence, fade resistance, and a short drytime.

What is claimed is:

1. A fusible print medium, comprising:

a photobase layer;

a vehicle sink layer; and a colorant-receiving layer comprising core-shell polymer particles having a hydrophilic shell and a fusible hydrophobic core, wherein the colorant-receiving layer is configured to have a phase inversion that encapsulates a colorant in the colorant-receiving layer, and wherein the hydrophilic shell comprises a latex vinyl polymer, and wherein cationic mordant is fused or grafted to a surface of the hydrophilic shell to provide mordant properties to the colorant-receiving layer, the cationic mordant being selected from the group consisting of a polyamine, a polyethyleneimine, a polyamidoamine, a guaternary amine polymer and derivatives thereof.

2. The fusible print medium of claim 1, wherein the colorant-receiving layer is configured to invert from a porous, hydrophilic surface to a continuous layer having a hydrophobic surface.

3. The fusible print medium of claim 2, wherein the colorant-receiving layer is configured to invert from a porous, hydrophilic surface to a continuous layer having a hydrophobic surface upon exposure to heat, pressure, or combinations thereof.

4. The fusible print medium of claim 2, wherein the colorant-receiving layer is configured to invert from a porous, hydrophilic surface to a continuous layer having a hydrophobic surface upon exposure to a temperature greater than a glass transition temperature of the fusible hydrophobic core.

5. The fusible print medium of claim 1, wherein the colorant is encapsulated in hydrophilic domains in the colorant-receiving layer by the phase inversion.

6. The fusible print medium of claim 1, wherein the fusible hydrophobic core is selected from the group consisting of a copolymer of acrylate and methacrylate, a styrene-acrylic polymer, a vinyl acetate-acrylic, a vinyl acetate-ethylene, and a copolymer of acrylonitrile.

7. The fusible print medium of claim 1, further comprising a topcoat layer.

8. A method of printing a photographic quality image, comprising:

providing a fusible print medium comprising a photobase layer, a vehicle sink layer, and a colorant-receiving layer, the colorant-receiving layer having a porous, hydrophilic surface and comprising core-shell polymer particles having a hydrophilic shell and a fusible hydrophobic core, wherein the hydrophilic shell comprises a latex vinyl polymer, and wherein cationic mordant is fused or grafted to a surface of the hydrophilic shell to provide mordant properties to the colorant-receiving layer, the cationic mordant being selected from the group consisting of a polyamine, a polvethyleneimine, a polyamidoamine, a quaternary amine polymer and derivatives thereof;

depositing inkjet ink onto the fusible print medium to print a desired image; and fusing the colorant-receiving layer into a continuous, hydrophobic film.

9. The method of claim 8, wherein fusing the colorant-receiving layer into a continuous, hydrophobic film comprises exposing the fusible print medium to heat, pressure, or combinations thereof.

10. The method of claim 9, wherein exposing the fusible print medium to heat, pressure, or combinations thereof comprises exposing the fusible print medium to a temperature greater than a glass transition temperature of the fusible hydrophobic core.

11. The method of claim 8, wherein exposing the fusible print medium to heat, pressure, or combinations thereof comprises exposing the fusible print medium to a heat source selected from the group consisting of a drying oven, an infrared oven, a heat lamp, an infrared lamp, a hot press, a laminator, and an iron.

12. The method of claim 8, wherein fusing the colorant-receiving layer into a continuous, hydrophobic film comprises encapsulating a colorant from the inkjet ink in hydrophilic domains in the colorant-receiving layer.

13. The method of claim 8, wherein fusing the colorant-receiving layer into a continuous, hydrophobic film comprises contacting the fusible hydrophobic core with a coalescing agent.

14. The method of claim 13, wherein contacting the fusible hydrophobic core with a coalescing agent comprises incorporating the coalescing agent into the inkjet ink.

15. The method of claim 13, wherein contacting the fusible hydrophobic core with a coalescing agent comprises contacting the fusible hydrophobic core with a coalescing agent selected from the group consisting of 2,2,4-trimethyl-1,3-pentanediol monoisobutyrate, ethylene glycol monobutyl ether, diethylene glycol monobutyl ether, diethylene glycol monomethyl ether, propylene glycol monomethyl ether, and dipropylene glycol monomethyl ether.

16. A method of producing a fusible print medium, comprising:

forming a vehicle sink layer on a photobase layer; and forming a colorant-receiving layer on the vehicle sink layer, the colorant-receiving layer comprising core-shell polymer particles having a hydrophilic shell and a fusible hydrophobic core, wherein the colorant-receiving layer is configured to invert from a porous, hydrophilic surface to a continuous layer having a hydrophobic surface, and wherein the hydrophilic shell comprises a latex vinyl polymer, and wherein cationic mordant is fused or grafted to a surface of the hydrophilic shell to provide mordant properties to the colorant-receiving layer, the cationic mordant being selected from the group consisting of a polyamine, a polyethyleneimine, a polyamidoamine, a quaternary amine polymer and derivatives thereof.

17. The method of claim 16, wherein forming a colorant-receiving layer comprising core-shell polymer particles comprises forming the colorant-receiving layer from the latex vinyl polymer and a fusible hydrophobic core that is selected from the group consisting of a copolymer of acrylate and methacrylate, a styrene-acrylic polymer, a vinyl acetate-acrylic, a vinyl acetate-ethylene, and a copolymer of acrylonitrile.

18. The method of claim 16, further comprising forming a topcoat layer on the colorant-receiving layer.

* * * * *

UNITED STATES PATENT AND TRADEMARK OFFICE

CERTIFICATE OF CORRECTION

PATENT NO. : 7,086,732 B2
APPLICATION NO. : 10/629230
DATED : August 8, 2006
INVENTOR(S) : Kasperchik et al.

It is certified that error appears in the above-identified patent and that said Letters Patent is hereby corrected as shown below:

In the Claims

Col. 11 (line 20), claim 1 delete "guaternary" and insert therefor --quaternary--.

Col. 11 (line 58), claim 8 delete "polvethyleneimine," and insert therefor --polyethyleneimine,--.

Signed and Sealed this

Fifth Day of February, 2008

JON W. DUDAS
*Director of the United States Patent and Trademark Office*